US005538441A

United States Patent [19]

Paolucci et al.

[11] Patent Number: 5,538,441

[45] Date of Patent: Jul. 23, 1996

[54] ELECTRIC CONNECTOR

[75] Inventors: Bruno Paolucci, Rivalta; Alessandro Genta, Turin, both of Italy

[73] Assignee: Framatome Connectors International, Courbevoie, France

[21] Appl. No.: 246,423

[22] Filed: May 20, 1994

[30] Foreign Application Priority Data

May 21, 1993 [IT] Italy ..... TO93A0354

[51] Int. Cl.[6] ..... H01R 13/40

[52] U.S. Cl. ..... 439/589; 439/587

[58] Field of Search ..... 439/275, 274, 439/271, 589, 587

[56] References Cited

U.S. PATENT DOCUMENTS 3,818,420 6/1974 Barr ..... 439/274 X 4,981,446 1/1991 Lazaro, Jr. et al. ..... 439/275 X 5,133,669 7/1992 Barnhouse et al. ..... 439/931.1 X 5,145,410 9/1992 Maejima et al. ..... 439/587 X

*Primary Examiner*—P. Austin Bradley

*Assistant Examiner*—Daniel Wittels

*Attorney, Agent, or Firm*—Pollock, Vande Sande & Priddy

[57] ABSTRACT

An electric connector comprising an insulating body of plastic material having a number of axial cavities housing respective electric terminals, and a recess formed in the rear end of the body, communicating with the cavities, and housing a seal having openings enabling insertion of the terminals inside the cavities and annular sealing lips cooperating sealingly with the cables of the terminals. The annular lips project axially towards the respective cavities from a surface of the seal cooperating with projections extending from the intersections of the walls defining the cavities, for preventing contact between the lips and the walls during insertion of the terminals.

9 Claims, 3 Drawing Sheets

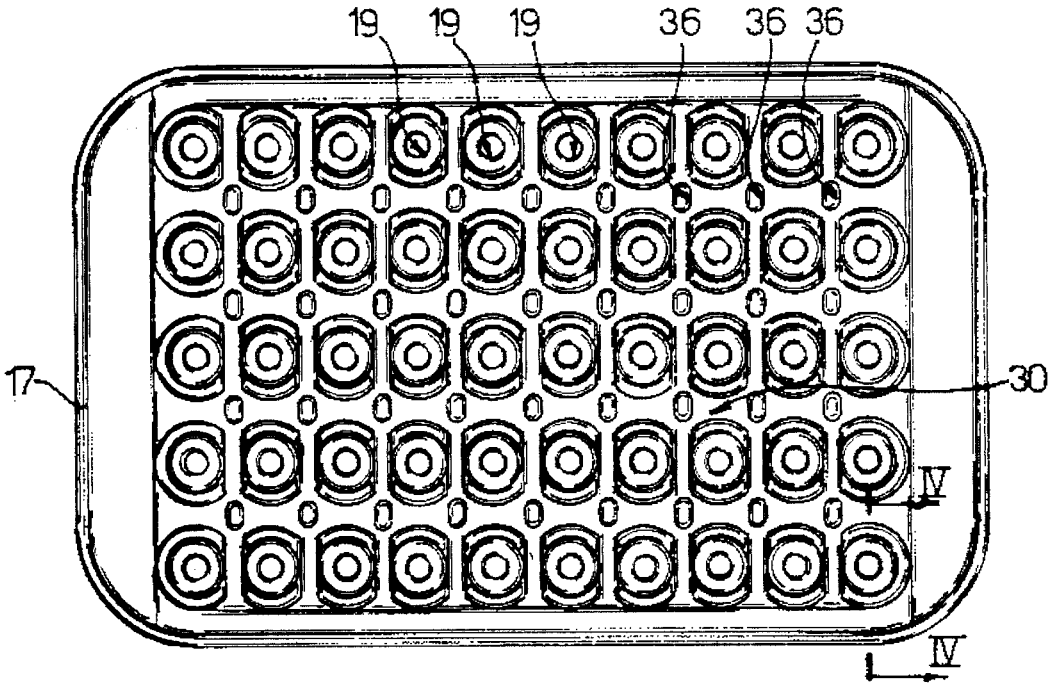
Fig.3
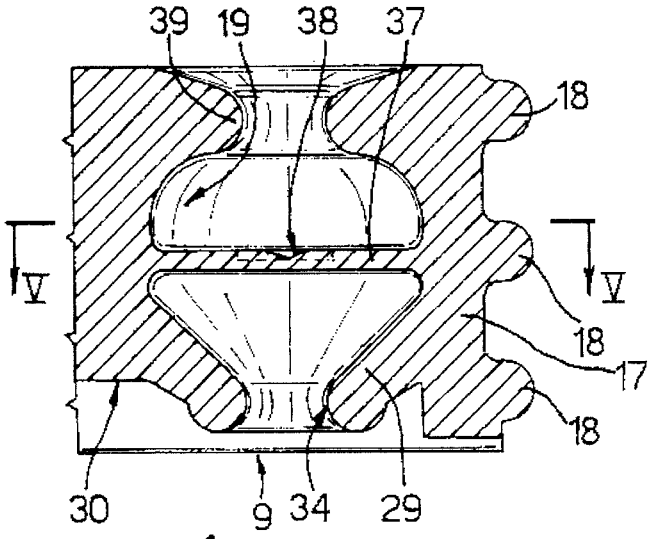
Fig. 4
Fig.5
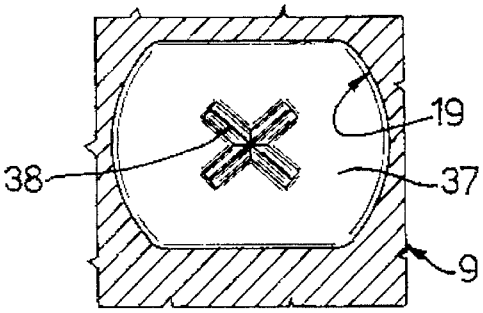

ELECTRIC CONNECTOR

FIELD OF THE INVENTION

The present invention relates to an electric connector.

BACKGROUND OF THE INVENTION

Electric connectors are known comprising an insulating body made of plastic material and having a number of axial cavities housing respective electric terminals; and a recess formed in the rear end of the body, communicating with these cavities and housing a seal of elastomeric material having a number of openings respectively facing the cavities in the body for enabling assembly of the terminals inside the cavities. The openings normally comprise inner annular projections or lips, which are deformed radially during insertion of the terminals, and, after assembly, cooperate elastically with the terminal cables for insulating the inside of the connector from the outside environment.

FR-B-2407579 and FR-A-2602374 illustrate connectors of the aforementioned type wherein the openings in the seal also present transverse membranes pierceable by the terminals during assembly.

This solution provides for sealing against external agents in the event that not all the cavities are engaged by respective terminals, in which case the unused cavities are protected by the unpierced membranes.

A drawback of known connectors of the type briefly described above is that they fail to ensure optimum sealing of the cables, particularly when these are subject to flexing.

To improve sealing performance, connectors have been proposed with a seal having openings defining a conical inner sealing lip tapering in the insertion direction of the terminal, as illustrated in U.S. Pat. No. 4,460,227. Such a seal, however, is limited to connectors with a small number of terminals, and wherein the center distance between terminals is such as to permit openings having a much larger section than the related terminal, to prevent passage of the terminal through the conical sealing lip from expanding the lip against the walls of the opening, thus resulting in excessive mechanical, and particularly shearing, stress on the lip, in turn resulting, in extreme cases, in at least partial cutting of the lip.

SUMMARY OF THE INVENTION

It is an object of the present invention to provide an electric connector designed to overcome the drawbacks typically associated with known connectors of the aforementioned type.

According to the present invention, there is provided an electric connector comprising an insulating body having a number of axial cavities; a number of electric terminals connectable to respective electric cables and housed in respective cavities; and a seal cooperating in sealing manner with the body and facing the cavities. The seal has a number of openings facing respective cavities in the body, for enabling insertion of the terminals inside the cavities, and the openings presenting respective annular, substantially conical sealing lips cooperating with the cables. The characterized by the fact that said annular lips project axially from the surface of the seal facing the respective cavities, and the connector comprises spacing means interposed between the seal and the cavities, for preventing contact between the lips and the walls defining the respective said cavities, when the terminals are inserted through the lips.

BRIEF DESCRIPTION OF THE DRAWINGS

A preferred, non-limiting embodiment of the present invention will be described by way of example with reference to the accompanying drawings, in which:

FIG. 3 is a plan view of the seal on the FIG. 1 connector;

FIG. 4 shows a larger-scale section along line IV—IV in FIG. 3;

FIG. 5 shows a section along line V—V in FIG. 4;

DETAILED DESCRIPTION OF THE INVENTION

Figure 1:
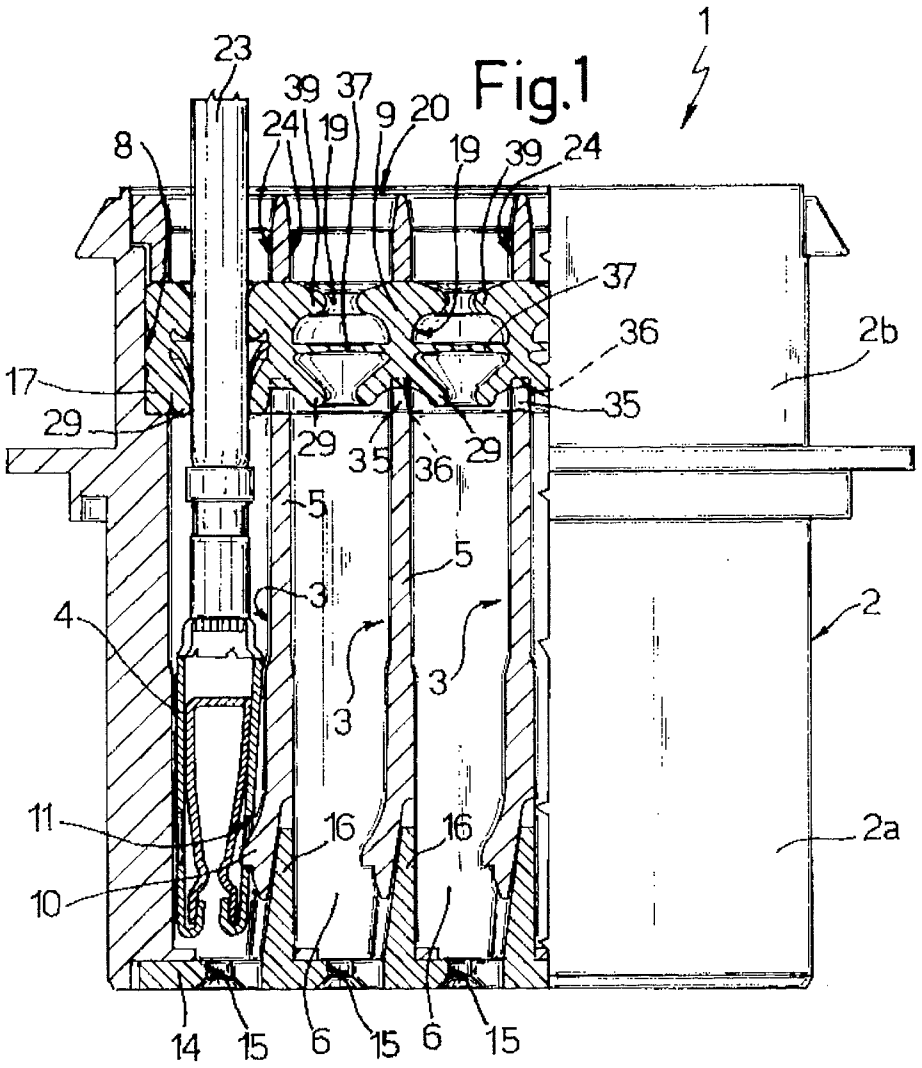
FIG. 1 shows a longitudinal section of an electric connector in accordance with the present invention.

FIG. 1 indicates a multiway electric connector 1, particularly for vehicle electric systems.

Connector 1 comprises a substantially parallelepiped body 2 made of insulating plastic material and defining internally a number of axial through cavities 3 for housing respective, e.g., female, electric terminals 4.

More specifically, body 2 comprises a front portion 2*a* designed to mate with a complementary electric connector (not shown) having electric terminals complementary to terminals 4; and a rear portion 2*b*. Cavities 3 are formed in portion 2*a*, are mutually separated by a number of walls 5, 6 intersecting at right-angles to one another and communicate with a recess 8 formed in rear portion 2*b* of body 2 and housing in sealing manner a seal 9 described in detail hereinbelow.

Terminals 4 are retained inside respective cavities 3 by conventional retaining means consisting, for example, of flexible tabs 10 formed in walls 5 and cooperating positively with an opening 11 in respective terminals 4.

Connector 1 conveniently comprises a front cover 14, which clicks on to body 2 and presents a number of openings 15 facing respective cavities 3 and enabling insertion into cavities 3 of respective electric terminals complementary to terminals 4. Cover 14 also presents a number of integral projections 16 projecting inside body 2 and cooperating with flexible tabs 10 for maintaining them in the deformed position engaging respective terminal 4, and so preventing withdrawal of the terminal from cavity 3.

Seal 9 (FIGS. 3 to 6) is substantially in the form of a flat rectangle, and presents an edge 17 cooperating in sealing manner, and with a small amount of transverse forcing, with the lateral walls of recess 8, to which end, edge 17 presents a number of parallel, annular outer projections 18 cooperating elastically with the walls.

Seal 9 presents a number of openings 19 facing respective cavities 3, and which provide for enabling insertion of terminals 4 inside cavities 3, and present sealing elements (to be described in detail hereinbelow) cooperating in use with terminal cables 23.

Figure 2:
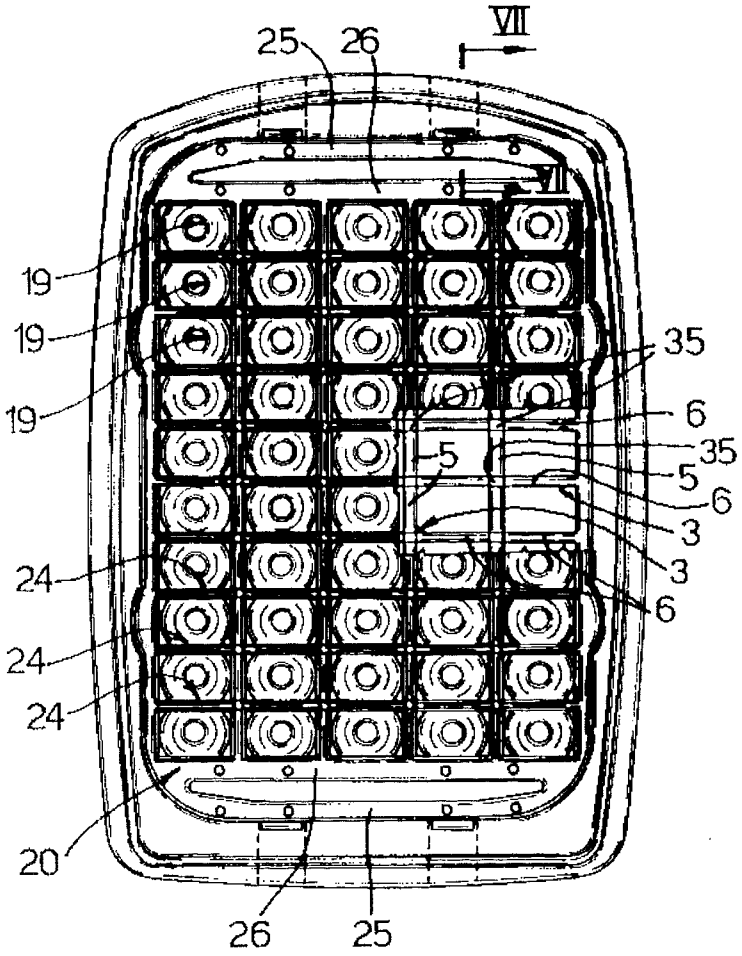
FIG. 2 is a rear view of the FIG. 1 connector.
Figure 7:
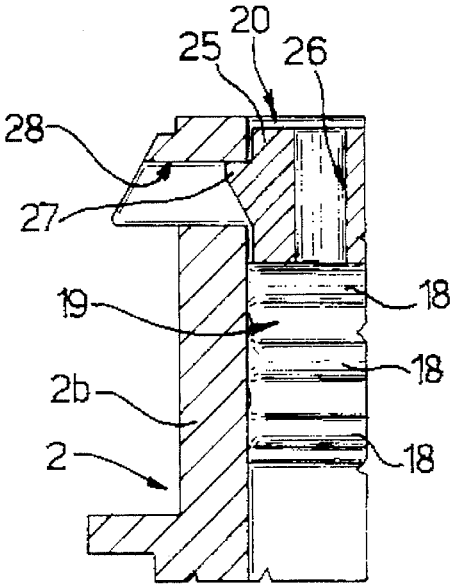
FIG. 7 shows a larger-scale partial section along line VII—VII in FIG. 2.

Seal 9 is maintained inside recess 8 by a grid element 20 facing seal 9 and which clicks inside the mouth portion of recess 8. Element 20 (FIG. 2) presents a number of through openings 24 facing openings 19 in seal 9 and, hence, cavities 3, and of substantially the same cross section as cavities 3. Element 20 also presents a pair of elongated flexible grips 25 extending parallel to respective opposite sides 26 of element 20 and integrally connected with element 20 at either end. Each grip 25 presents a pair of teeth 27 (FIG. 7) designed to click inside respective seats 28 formed in portion 2*b* of body 2 of connector 1.

According to the present invention, each opening 19 in seal 9 presents an annular, substantially conical sealing lip 29 originating on the major surface 30 of seal 9 facing cavities 3, and extending axially towards cavities 3.

Lips 29 are highly deformable for enabling passage of the respective terminal, but present a minimum inner section 34 smaller than the cross section of respective cable 23, so as to elastically seal cable 23 once the terminal is assembled.

Element 20 maintains seal 9 contacting a number of projections 35 extending axially inside recess 8 from portion 2*a* of body 2, at the intersections of walls 5 and 6 defining cavities 3. For this purpose, surface 30 of seal 9 conveniently presents a number of impressions 36 located between openings 19 and designed to receive one end of projections 35. Projections 35 are so sized that surface 30 of seal 9 is detached from walls 5 and 6 by a distance conveniently greater than the amount by which lips 29 project from surface 30.

Openings 19 in seal 9 conveniently also present a pierceable intermediate transverse membrane 37 integral with seal 9, and which provides for sealing in the event one or more cavities 3 are left unused.

According to a further characteristic of the present invention, membranes 37 present a preferential breakthrough portion 38 defined by a weaker cross-shaped portion (FIG. 5) centered on the axis of opening 19.

Finally, the inlet portion of openings 19 presents a second annular lip 39 having a rounded profile and also cooperating elastically in sealing manner with a respective cable.

Connector 1 is assembled as follows.

Seal 9 is inserted inside recess 8 and secured by means of grid element 20, and each terminal 4 is inserted through a respective opening 24 in element 20 and pushed through a respective opening 19 in seal 9 into respective cavity 3. During insertion, membrane 37 is pierced and torn cleanly along the preferential tear lines.

As terminal 4 is inserted through lip 29, this expands radially by a fairly considerable amount, and with no interference from walls 5 and 6, by virtue of the clearance provided by projections 35 between seal 9 and walls 5 and 6.

Once inserted inside respective cavities 3, terminals 4 are locked in place by flexible tabs 10, at which point, cover 14 is fitted on to body 2 for preventing withdrawal, as already described.

In use, connector 1 mates with a similar connector having male terminals for defining an airtight connecting unit.

Figure 8:
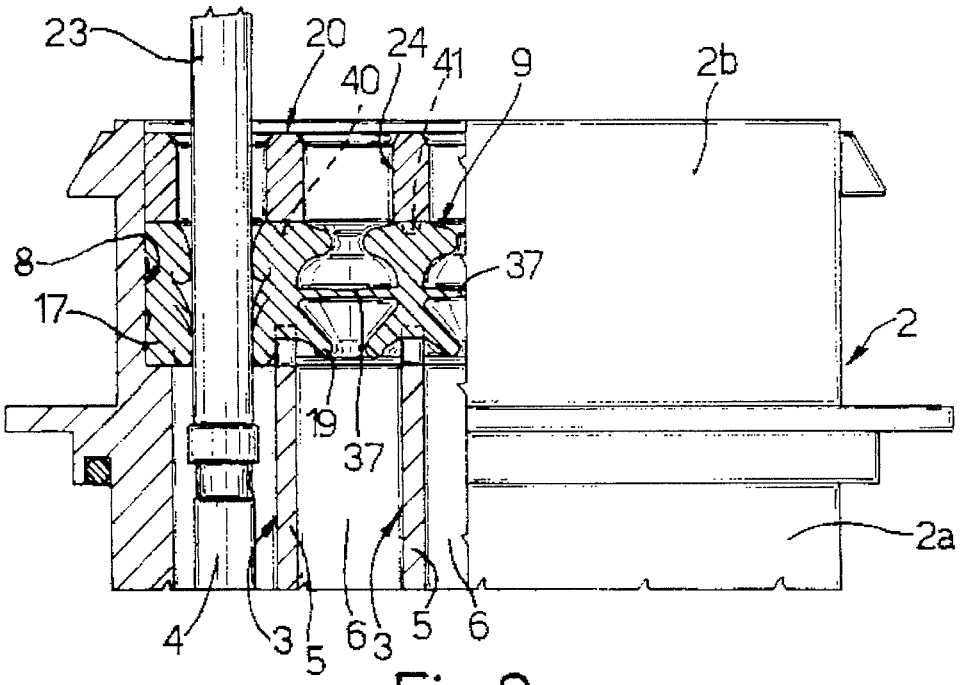
FIG. 8 shows a partial longitudinal section of an alternative embodiment of the FIG. 1 connector.
Figure 6:
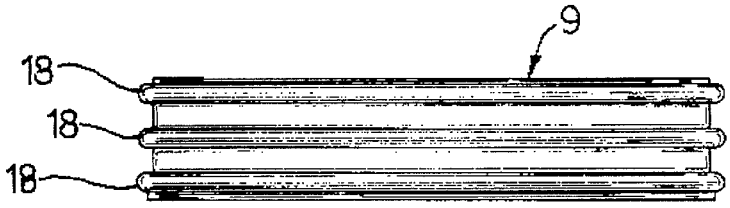
FIG. 6 shows a side view of the FIG. 3 seal.

FIG. 8 shows an alternative embodiment of connector 1, wherein the rear face of seal 9 also presents impressions 40 engaged by respective projections 41 on grid element 20. This solution provides for further improving transverse retention of seal 9, thus ensuring openings 19 are perfectly aligned with cavities 3 and openings 24 on grid element 20.

The advantages of connector 1 according to the present invention will be clear from the foregoing description.

Firstly, combined use of a seal 9 with projecting conical lips 29 and spacer means (projections 35) interposed between seal 9 and cavities 3 prevents lips 29 from contacting walls 5 and 6 during insertion of terminals 4, which contact would result in cutting of the lip due to the minimum difference in the section of cavities 3 and terminal 4, which would act respectively as a die and punch.

A further advantage of the present invention lies in the transverse anchorage of a number of intermediate points of seal 9 due to mutual engagement of projections 35 and impressions 36 (and possibly projections 41 and impressions 40), thus preventing transverse deformation of the seal and, in particular, ensuring openings 19 are equally spaced and consequently aligned with cavities 3 in the event not all of terminals 4 are assembled in the respective cavities.

Finally, preferential breakthrough portions 38 in membranes 37 provide for neatly piercing the membrane and so preventing fragments of the seal material from detaching and infiltrating inside cavity 3.

To those skilled in the art, it will be clear that changes may be made to connector 1 as described and illustrated herein, without, departing from the scope of the present invention. For example, changes may be made to the number and design of the terminals and respective cavities, and to the means whereby the terminals are retained inside the cavities.

In particular, the terminals may be male as opposed to female types.

We claim:

1. An electric connector comprising an insulating body comprising axial cavities separated by walls, electric terminals connectable to respective electric cables and housed in respective cavities, and a seal cooperating in sealing manner with said body and having a surface facing said cavities, said seal comprising openings facing respective said cavities and having respective annular, substantially conical sealing lips cooperating with said cables, said sealing lips projecting axially from said surface of said seal facing toward respective said cavities, said connector further comprising spacing means interposed between said walls and said surface of said seal for allowing said lips to expand radially and for preventing contact between said lips and said walls when said terminals are inserted through said lips.

2. A connector as claimed in claim 1, wherein said spacing means consist of a number of projections integral with said body and cooperating with portions of said seal located between said openings.

3. A connector as claimed in claim 2, wherein said projections extend axially from intersections of said walls defining said cavities in said body.

4. A connector as claimed in claim 2, wherein said seal comprises a number of impressions designed to cooperate with said projections.

5. A connector as claimed in claim 1, wherein said seal is housed inside a recess in said body, and is locked inside said recess by a grid element having openings facing said openings in said seal.

6. A connector as claimed in claim 5, wherein said grid element clicks inside said recess in said body.

7. A connector as claimed in claim 1, wherein said seal comprises a number of pierceable membranes closing said openings.

8. A connector as claimed in claim 7, wherein said membranes comprise a preferential breakthrough portion.

9. A connector as claimed in claim 8, wherein said preferential breakthrough portion is a weakened cross-shaped portion centered on an axis of a respective opening.

* * * * *